United States Patent [19]

Hatters et al.

[11] 4,207,145

[45] Jun. 10, 1980

[54] METHOD TO CONTROL CARBON FORMATION AND TEMPERATURE IN THE FREE SPACE OF COKE OVEN CHAMBERS

[75] Inventors: Harry D. Hatters; Joseph M. both of Stoll, Pittsburgh, Pa.

[73] Assignee: Jones & Laughlin Steel Corporation, Pittsburgh, Pa.

[21] Appl. No.: 928,767

[22] Filed: Jul. 27, 1978

[51] Int. Cl.[2] ..... C10B 47/00; C10B 27/02

[52] U.S. Cl. ..... 201/41; 137/613; 201/26; 202/254; 202/263; 202/270

[58] Field of Search ..... 137/613; 202/133, 134, 202/137, 254, 258, 263, 269, 270; 201/26, 38, 41

[56] References Cited

U.S. PATENT DOCUMENTS

| | | | |
|---|---|---|---|
| 558,702 | 4/1896 | Perkins | 137/613 |
| 1,485,914 | 3/1924 | Greene | 202/263 X |
| 3,862,889 | 1/1975 | Lowe, Jr. | 202/258 |
| 4,103,708 | 8/1978 | Huntington | 137/614.11 |

FOREIGN PATENT DOCUMENTS

| | | | |
|---|---|---|---|
| 1105380 | 4/1961 | Fed. Rep. of Germany | 202/263 |
| 1381788 | 1/1975 | United Kingdom | 202/263 |

*Primary Examiner*—Joseph Scovronek
*Assistant Examiner*—Roger F. Phillips
*Attorney, Agent, or Firm*—Thomas H. Murray; Clifford A. Poff

[57] ABSTRACT

A jumper pipe forms a passageway between the free spaces above coal charges in adjacent coking chambers for the natural flow of relatively cooler coke oven gas from the free space above the coal charge in the most recently charged one of the coking chambers into the free space above the coal charge in the other of the coking chambers to reduce the relatively higher temperature therein. An inert atmosphere is maintained along at least part of the passageway to prevent the flow of coke oven gas essentially during decarburization and the pushing of coke from either of the two adjacent coking chambers. Valve members at opposite end portions of the jumper pipe are moved to at least partially-closed positions to facilitate the maintenance of an inert atmosphere therein. A supply or steam or gaseous nitrogen is used to maintain the inert atmosphere in the jumper pipe. The inert gas prevents the entrance of coke oven gas into a coking chamber while undergoing decarburization.

9 Claims, 3 Drawing Figures

METHOD TO CONTROL CARBON FORMATION AND TEMPERATURE IN THE FREE SPACE OF COKE OVEN CHAMBERS

BACKGROUND OF THE INVENTION

This invention relates to a method for suppressing carbonaceous deposits and reducing the temperature in the free spaces above coal charges in coking chambers by introducing untreated coke oven gas at a naturally occurring cooler temperature from the free space above a coal charge in the most recently charged one of two adjacent coking chambers into the free space above the coal charge in the adjacent one of the coking chambers. More particularly, the present invention relates to such a method wherein a jumper pipe is utilized to control the flow of coke oven gas essentially by establishing an inert atmosphere in the jumper pipe to prevent the flow of coke oven gases between the coking chambers during the time while coke is pushed from either of the chambers and, if desired, during decarburization of a coking chamber.

The conversion of coal into coke is carried out in a battery of coking chambers wherein the distillation process yields a volatile matter generally referred to in the art as coke oven gas that escapes into the free space above the coal charge in each of the coking chambers. The coke oven gas is drawn through an offtake or ascension pipe at one end of each coking chamber for passage through a damper valve into a collecting main that extends along the entire battery of coke oven chambers. In some coke oven battery arrangements, two gas-collecting mains are used; one main extending along the battery of coke ovens at the machine side, and one main extending along the battery of coke ovens at the coking side. The two gas-collecting mains are coupled by separate ascension pipes to each coking chamber. The function of either a single or two gas-collecting mains for a coke oven battery is to not only collect coke oven gas from the ovens but also to maintain at all times an accurately controlled pressure in the ovens during a coking process since the gas pressure during coking has a pronounced affect on the coke and coal chemicals. The temperature in the free space above a coal charge undergoes dynamic changes throughout the use of the coking chamber. During the actual coking process, the highest free space temperature occurs near the end of the coking process at about 1850° F.; however, higher temperatures in this area of the coking chamber occur during the decarburization process which is carried out while the oven chamber is empty by the introduction of air for combustion of carbon deposits that build up in the free space area, particularly on the roof area of the coking chamber. The decarburization process increases the temperature at the chamber roof. After the decarburization process is completed, the coking chamber receives a charge of coal whereby the large amounts of volatile matter usually referred to as coke oven gases undergo decomposition as they pass into the highly-heated environment at the roof of the coking chamber. At the same time, conditions are such that carbon deposits (which often may be thick due to layering of the deposits) begin to form on the chamber walls in the free space above the coal charge which, in turn, brings about the need, at the conclusion of the coking process, for a longer decarburization time and resulting higher roof temperatures.

A Beimann Main involves operational techniques for one of two gas-collecting mains extending along a coke oven battery to suppress carbonaceous deposits and avoid cracking of the coke oven gas in the space above a coal charge. The structure forming a Beimann Main is essentially the same as that required to form a conventional gas-collecting main. However, a Beimann gas-collecting main is employed to withdraw the coke oven gas from newly-charged coking chambers in which a relatively high pressure exists. The withdrawn gases are cooled by water sprays in the gas main and then cooled coke oven gas is passed downwardly through other ascension pipes into the free space above the coal charge in the various other oven chambers wherein the coking process has proceeded to near the end of the coking period. The pressure of the coke oven gas above the coal charge in a coking chamber which is near the end of the coking process is lower than an average gas pressure taken over the entire coking process. In this way, gas pressure in the coking chambers is controlled throughout the entire coke oven battery and a temperature control is provided for the free space above the coal charges in the oven chambers. The principle of a Beimann Main offers many desirable advantages but at the same time the actual use of a Beimann Main suffers from acute disadvantages which the present invention is designed to overcome. A Beimann Main requires a substantial capital investment to provide all of the various ascension pipes, valves, spray nozzles, water supply and cooling water treatment facilities, and a collector main. The ususal gas-collecting main remains a necessity. The problem of continued maintenance of the Beimann Main represents a substantial and continuous operating expense.

In cases where jumper pipes are used on a single collecting main battery, the necessary valves in the ascension pipes to control the flow of gases therein stick or otherwise malfunction due to deposits of tar whereby, for example, cold coke oven gas escapes through the malfunctioning valve into empty coking chambers. The gas usually burns, with an explosion, but combustion occurs at the end of the coking chamber and causes overheating of the door jamb.

SUMMARY OF THE INVENTION

It is an object of the present invention to provide a method to suppress carbonaceous deposits and reduce the temperature in the free space above coal charges in coking chambers by effectively controlling the flow of coke oven gas at naturally occurring temperatures through a passageway coupling together the free gas spaces in two adjacent coking chambers.

It is a further object of the present invention to provide a method for reducing the temperature in the free spaces above coal charges through the delivery of coke oven gas along a passageway interconnecting two adjacent coking chambers and preventing the flow of coke oven gas in such a passageway by maintaining an inert atmosphere at a positive pressure along at least a part of the length of the passageway.

More specifically, according to the present invention, there is provided a method for suppressing carbonaceous deposits and reducing the temperature in the free spaces above coal charges in coking chambers of a coke oven battery, the method including the steps of coupling a collector main at one end of each coking chamber to withdraw coke oven gas therefrom, providing a passageway for the flow of coke oven gas between each of at least two adjacent coking chambers, passing untreated coke oven gas at the naturally occurring cooler temperature from the free space above the coal charge in the most recently charged one of the two adjacent coking chambers through the passageway into the free space above the coal charge in the other of the coking chambers to reduce the relatively high temperature in the free space above the coal charge therein and preventing the flow of coke oven gas in the passageway essentially during the pushing of coke from either of the two adjacent coking chambers by maintaining an inert atmosphere along at least a part of the length of the passageway.

In the preferred aspect of the method according to the present invention, valve means in the passageway interconnecting two adjacent coking chambers are adjusted to at least reduce the flow of coke oven gas in the passageway before the introduction of a gas to produce an inert atmosphere in the passageway. It is preferred to employ a jumper pipe extending between openings in the oven roof for the two adjacent coking chambers. Steam is the preferred form of medium to form the inert atmosphere; however, gaseous nitrogen may be employed to form such an atmosphere. When two valves are used at opposite ends of the jumper pipe, the space between the valves in the jumper pipe is maintained at a positive pressure in excess of the pressure of the coke oven gas at one or both entry ends of the jumper pipe.

The method of the present invention includes the optional step of conducting untreated charging gases which are usually steam-rich into an adjacent coking chamber wherein the coking process has proceeded through, e.g., about 50% of the coking cycle. The coke oven gas liberated midway in the coking cycle does not usually include steam and the temperature in the free space above the coal charge is in excess of 1000° F., usually of the order of 1650° F. By introducing the steam-rich charging gases into the oven chambers under these conditions, a water-gas shift reaction rapidly occurs and effectively removes carbon from the free space above the coal charge while reducing the temperature therein.

These features and advantages of the present invention as well as others will be more fully understood when the following description is read in light of the accompanying drawings, in which.

Figure 1:
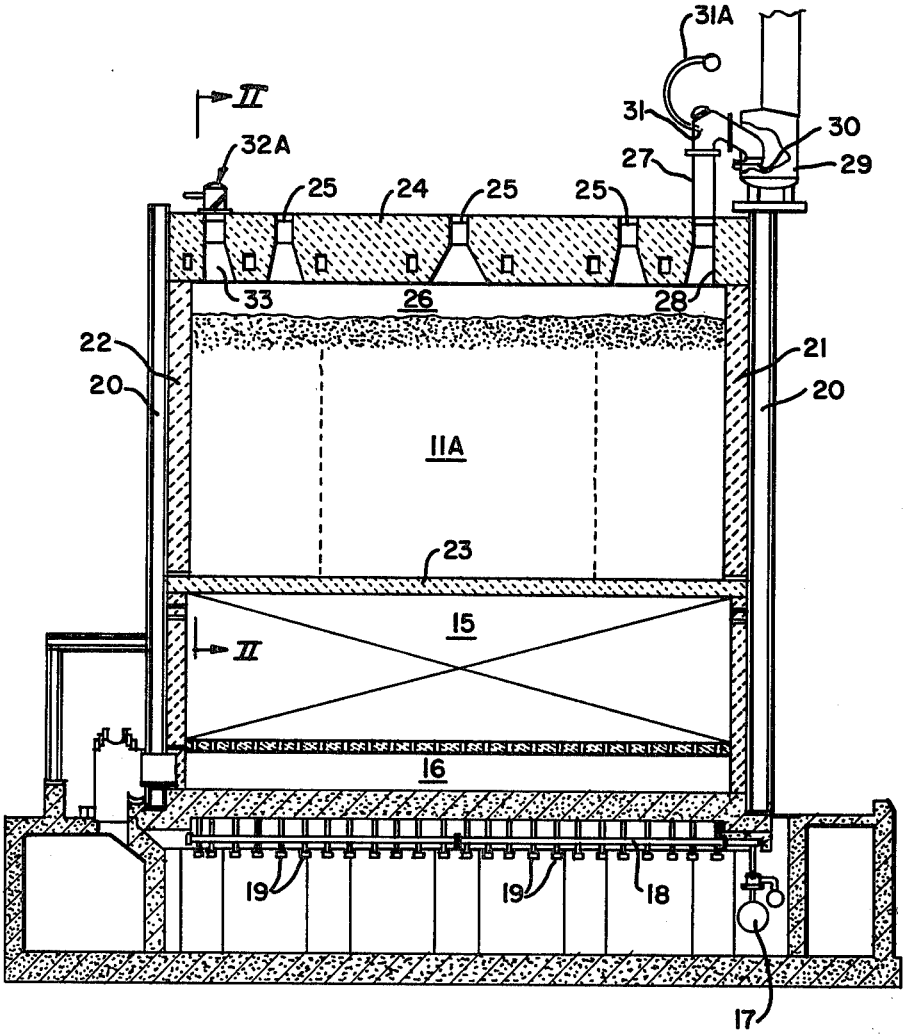
FIG. 1 is a cross-sectional view, in elevation, of a typical by-product coke oven including apparatus to carry out the method of the present invention.
Figure 3:
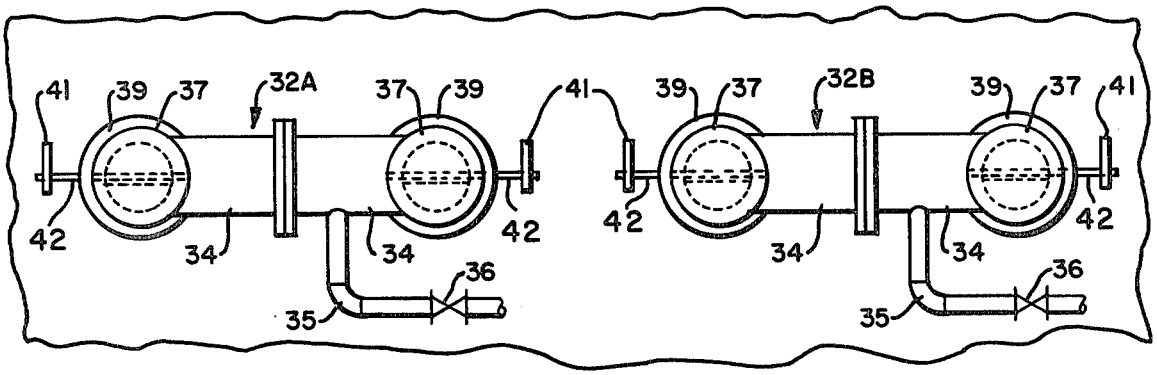
FIG. 3 is a partial plan view illustrating the jumper pipe apparatus to carry out the method of the present invention.
Figure 2:
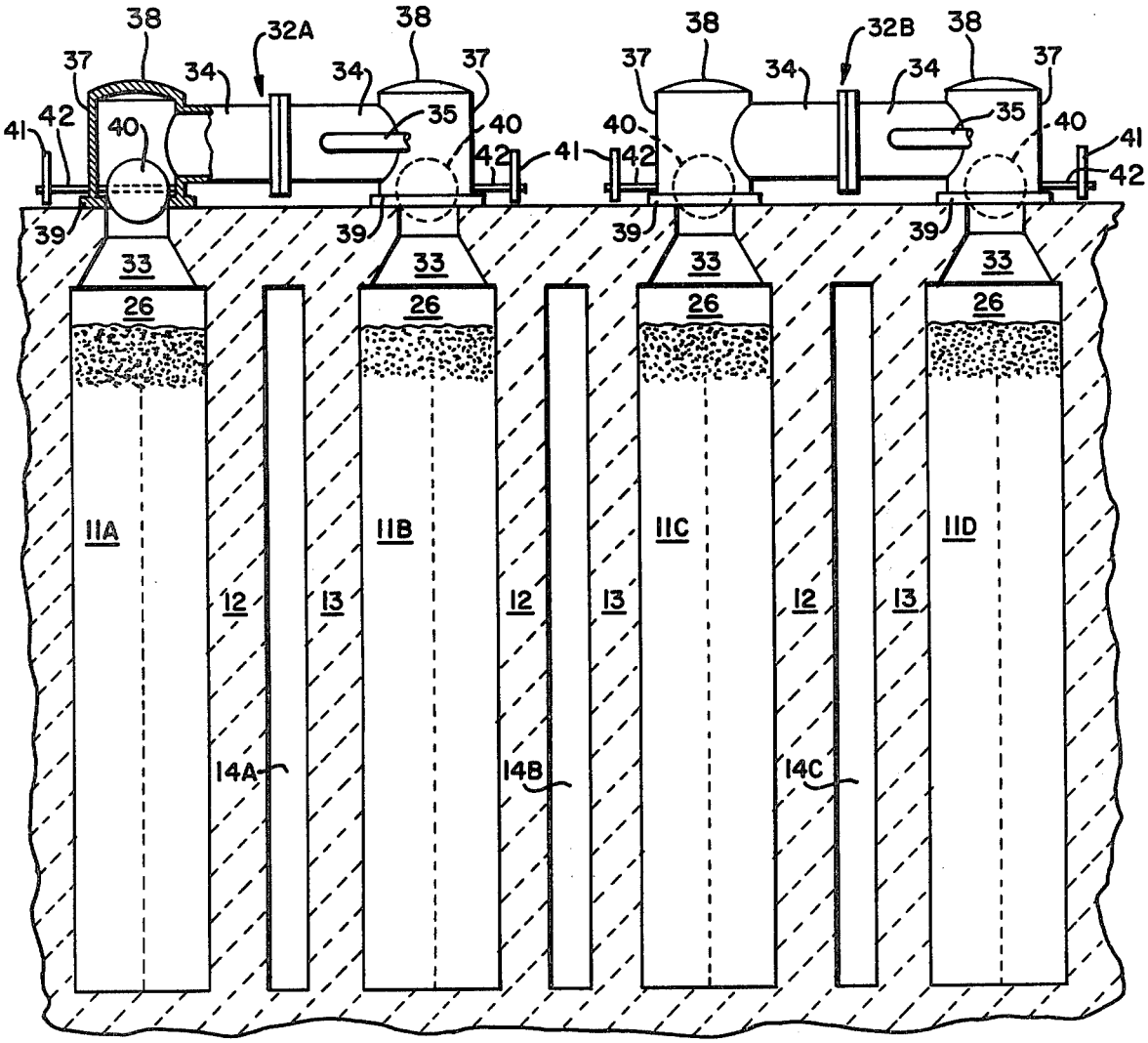
FIG. 2 is a sectional view taken along line II—II of FIG. 1.

In FIGS. 1–3, there is illustrated a portion of a coke oven battery that includes a plurality of coking chambers 11A, 11B, 11C, 11D, etc. Heating walls 12 and 13 extend along opposite sides of each coking chamber and include vertically-extending heating flues 14A, 14B, 14C, etc. The heating flues are connected in the well-known manner to regenerators 15 (FIG. 1) used to preheat combustion air supplied through oven sole flues 16. A gas supply main 17 is connected through a header 18 extending in a generally parallel relation to the extended length of each coking chamber for delivering the gas through vertically-arranged ducts 19 into the heating flues.

Buckstays 20 extend at spaced-apart intervals along each side of the coke oven battery to support the oven masonry thereof. A door 21 forms a closure for the coking chamber at the pusher side and a door 22 forms a closure for the coking chamber at the coke side. A hearth 23 is formed at the bottom of each chamber and a roof 24 extends along the top of each chamber. Coal is fed through charging holes 25, there being three shown in FIG. 1, into the coking chamber from a charging car, not shown. The amount of coal fed into the coking chamber through the charging openings is selected so that a gas free space 26 is maintained in the coking chamber along the top of the coal charge after leveling thereof. A standpipe 27, sometimes also referred to in the art as an ascension pipe, communicates with an opening 28 at the pusher side of the coking chamber for the delivery of coking gases from the free space above the coal charge into a gas-collecting main 29 that extends along the length of the entire coke oven battery. A liquor seal valve 30 is controllably positioned to isolate the coking chamber from the gas-collecting main at the conclusion of a coking process. A steam aspirator 31 is coupled through a valve or the like to a steam line 31A for inducing or otherwise controlling the draft on the coking chamber.

In accordance with the present invention, at the side of the coking chamber which is opposite the side of the ascension pipe, there is provided a plurality of individual jumper pipes 32A, 32B, etc. In the arrangement of parts for the coking chambers shown in the drawings, the gas-collecting main 29 is coupled by vertical ascension pipes 27 to each chamber in the battery at the pusher side of the chambers. Therefore, the jumper pipes 32A, 32B, etc. are located at the coking side of the coke oven battery. However, it is to be understood that the jumper pipes 32A, 32B, etc. may be arranged at the pusher side of the chambers when the gas-collecting main extends along the coking side of the chambers.

Each jumper pipe 32A, 32B, etc. connects together at least two coking chambers through openings 33 in the roofs thereof, It is within the scope of the present invention to provide a single jumper pipe to couple together three, four or more coke oven chambers. However, the jumper pipes are used to couple together only a relatively small number of coking chambers as distinguished from a gas-collecting main where all the coke oven chambers communicate with a single main.

As best shown in FIGS. 2 and 3, each jumper pipe includes horizontal pipe segments 34 joined together by a flange. One pipe segment has an opening in its side wall which is joined with a supply pipe 35 having a control valve 36 to control the delivery of steam from a suitable supply, not shown. The free end of each pipe segment is secured to an opening in the side wall of the vertically-arranged header pipe 37. The upper end of the header pipe is closed in an end cover 38 while the lower end includes a flange 39 contacting the top surface of the oven roof. The header pipe 37 extends downwardly, if desired, from flange 39 to form an interlocking relation with the opening 33 in the oven roof. The header pipe 37 supports a pivot shaft 42 extending through the pipe just above flange 39 and carries within the header pipe a valve plate 40. The position of valve plate 40 is controlled by movement of a lever 41.

To carry out the method of the present invention, the two or more adjacent coking chambers are connected together by the jumper pipe for the flow of coke oven gas between the oven chambers at all times except during pushing of coke from one of the coking chambers and chamber decarburization. The feeding of coke oven gas in this manner allows passage of the naturally cooler coke oven gas from one coking chamber to cool the roof in the adjacent coking chamber coupled thereto. The coking chamber undergoing cooling at the oven roof depends upon the direction of flow of coke oven gas in the jumper pipe which is, in turn, determined by the times into the coking cycle by the adjacent coking chambers. When coke is pushed from one of two coking chambers coupled together by a jumper pipe, both valve plates 40 are preferably closed or rotated to a nearly-closed position while the area between the valves is pressurized with an inert gas such as steam supplied through line 35 by the operation of valve 36. Gaseous nitrogen may be employed, if desired, to carry out the pressurization in the area between the valves and the jumper pipe. Irrespective of the media chosen to maintain an inert atmosphere in the jumper pipe during the pushing operation, the inert atmosphere eliminates a flow of coke oven gas from the oven chamber during the coking operation into the oven chamber undergoing the pushing operation. By eliminating the flow of coke oven gas into the oven chamber being pushed, excess heating of the roof and jamb is prevented due to burning of coke oven gas. An auxiliary benefit is realized through the use of steam to form the inert atmosphere in the jumper pipe since the steam facilitates removal of carbon in the area of the valve plates because the steam reacts with the hot carbon. During decarburization, it is preferred but not believed absolutely essential, to maintain an inert atmosphere in the jumper pipe to prevent the flow of coke oven gas therein unless there is a substantial flow of coke oven gas into the chamber during decarburization.

In the operation of the coke oven battery, temperatures in excess of 1500° F. in the free space above the coal charge in each oven chamber brings about an increase in the deposition of carbon on the oven roof, the free space brickwork and the standpipe or ascension pipe. Excessive build-up of carbon leads to operational problems when pushing a coking chamber, filling a coking chamber and efforts to maintain a desired, accurately-controlled gas pressure in the free space above the coal charge. Tests were conducted to measure the free space temperature during the coking cycle at various openings in the jumper pipe valves and are reported in the following Table I:

TABLE I

| Temperature Measurements, P-3 Battery | | | | | | |
|---|---|---|---|---|---|---|
| | | Avg. Battery Flue | Butterfly Valve | Time in Coke | Temperature °F. | |
| Test No. | Oven No. | Temp. °F. | Position | Cycle Hrs. | Jumper Pipe | Free Space Coke Oven |
| 1 | 1-5 | 2353 | Closed | 0.5 | 390 | 1725 |
| | | | | 8.0 | 345 | 1670 |
| | | | | 15.0 | 230 | 1845 |
| 2 | 1-5 | 2330 | 45° | 0.5 | 765 | 1685 |
| | | | | 8.0 | 825 | 1650 |
| | | | | 15.0 | 740 | 1685 |
| 3 | 1-5 | 2352 | 90° | 0.5 | 965 | 1700 |
| | | | | 8.0 | 1035 | 1620 |
| | | | | 15.0 | 1075 | 1575 |
| 4 | 1-6 | 2355 | Closed | 0.5 | 405 | 1750 |
| | | | | 8.0 | 260 | 1700 |
| | | | | 15.0 | 235 | 1850 |
| 5 | 1-6 | 2327 | 45° | 0.5 | 765 | 1710 |
| | | | | 8.0 | 360 | 1625 |
| | | | | 15.0 | 880 | 1610 |

TABLE I-continued

| Temperature Measurements, P-3 Battery | | | | | | |
|---|---|---|---|---|---|---|
| | | Avg. Battery Flue | Butterfly Valve | Time in Coke | Temperature °F. | |
| Test No. | Oven No. | Temp. °F. | Position | Cycle Hrs. | Jumper Pipe | Free Space Coke Oven |
| 6 | 1-6 | 2345 | 90° | 0.5 | 1035 | 1655 |
| | | | | 8.0 | 1025 | 1535 |
| | | | | 15.0 | 1025 | 1560 |

These tests demonstrate that a temperature reduction of 100° F. was achieved in the free space above a coal charge in a coking chamber measured by operating the jumper pipe valves in a fully-open position, i.e., at 90° position from closed during the coking cycle. This 100° F. temperature reduction was realized from a temperature of 1670° F. at charging to 1575° F. at pushing. Such temperature characteristics are comparable to the usual increase of 100° F. in the free space above a coal charge wherein at charging, a temperature of 1740° F. increases to a temperature of 1840° F. at pushing. These temperature measurements were taken with the valves in the jumper pipe in the fully-closed position without maintaining an inert atmosphere to prevent the flow of gas between the adjacent coking chambers, thus representing the normal practice prior to the present invention. Tests with the jumper pipe valves in a 45° position from the closed, i.e., midway between open and closed positions, were made and also indicate that a temperature reduction was achieved in the coking chamber in the free space above the coal charge.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A method for suppressing carbonaceous deposits and reducing the temperature in the free spaces above coal charges in coking chambers of a coke oven battery, said method including the steps of:

coupling a collector main to one end of each coking chamber to withdraw coke oven gas therefrom, providing a passageway for the flow of coke oven gas connecting at least two coking chambers, passing untreated coke oven gas at the naturally occurring cooler temperature from the free space above the coal charge during the coking cycle in the most recently charged one of the connected coking chambers through said passageway into the free space above the coal charge of another of the coking chambers during the coking cycle to reduce the relatively higher temperature in the free space above the coal charge therein, the coke oven gas passed through said passageway occurring essentially during the actual coking cycles by both of said coke oven chambers, and preventing the flow of coke oven gas in said passageway essentially during the pushing of coke from either of the two coking chambers by maintaining a positive pressure in said passageway.

2. The method according to claim 1 including the further step of adjusting a valve means in said passageway to at least reduce the flow of coke oven gas before said step preventing the flow of coke oven gas.

3. The method according to claim 1 wherein said step of providing a passageway includes coupling a jumper pipe to two adjacent coking chambers through openings in the coke oven roof.

4. The method according to claim 3 wherein said step of preventing the flow of coke oven gas includes feeding steam into said jumper pipe to inhibit the flow of coke oven gas therein.

5. The method according to claim 3 including the further step of closing the valve means at each of spaced-apart locations in said jumper pipe and thereafter feeding steam into said jumper pipe between said valve means for said step of preventing the flow of coke oven gas.

6. The method of claim 5 wherein said step of preventing the flow of coke oven gas includes pressurizing the space in said jumper pipe between the valve means with inert gas at a pressure which exceeds the pressure of the coke oven gas at the valve means.

7. The method according to claim 3 wherein said step of preventing the flow of coke oven gas includes feeding gaseous nitrogen into said jumper pipe to inhibit the flow of coke oven gas therein.

8. The method according to claim 1 wherein said step of preventing the flow of coke oven gas includes maintaining said passageway pressurized with inert gas throughout decarburizing either of the two adjacent coking chambers.

9. The method according to claim 1 including the further step of using said passageway to conduct untreated and steam-rich charging gases into the free space above the partially-coked coal charge in the adjacent coking chamber to remove carbon by a water-gas shift reaction and reduce the temperature in the space above the coal charge.

* * * * *